US005250403A

United States Patent [19]

Antoniades et al.

[11] Patent Number: 5,250,403

[45] Date of Patent: Oct. 5, 1993

[54] PHOTOGRAPHIC ELEMENTS INCLUDING HIGHLY UNIFORM SILVER BROMOIODIDE TABULAR GRAIN EMULSIONS

[75] Inventors: Michael G. Antoniades; Richard L. Daubendiek, both of Rochester; David E. Fenton, Fairport; Jeffrey L. Hall; Ramesh Jagannathan, both of Rochester, all of N.Y.

[73] Assignee: Eastman Kodak Company, Rochester, N.Y.

[21] Appl. No.: 842,683

[22] Filed: Feb. 27, 1992

Related U.S. Application Data

[63] Continuation-in-part of Ser. No. 679,712, Apr. 3, 1991, abandoned, and a continuation-in-part of Ser. No. 679,714, Apr. 3, 1991, abandoned.

[51] Int. Cl.[5] ..... G03C 7/26

[52] U.S. Cl. ..... 430/505; 430/502; 430/503; 430/509; 430/567; 430/568; 430/569

[58] Field of Search ..... 430/505, 502, 567, 503, 430/496, 509, 568, 569

[56] References Cited

U.S. PATENT DOCUMENTS

| | | | |
|---|---|---|---|
| 3,897,935 | 8/1975 | Forster et al. | 259/4 |
| 4,171,224 | 10/1989 | Verhille et al. | 96/94 |
| 4,334,012 | 6/1982 | Mignot | 430/567 |
| 4,414,310 | 11/1983 | Daubendiek et al. | 430/505 |
| 4,425,426 | 2/1984 | Abbott et al. | 430/502 |
| 4,439,520 | 3/1984 | Kofron et al. | 430/434 |
| 4,693,964 | 9/1987 | Daubendiek et al. | 430/505 |
| 4,713,320 | 12/1987 | Maskasky | 430/567 |
| 4,797,354 | 7/1990 | Saitou | 430/567 |
| 4,879,208 | 11/1989 | Urabe | 430/569 |

FOREIGN PATENT DOCUMENTS

0362699A3 3/1991 European Pat. Off. .

OTHER PUBLICATIONS

*Research Disclosure*, Aug. 1983, Item 23212.

*Primary Examiner*—Charles L. Bowers, Jr.
*Assistant Examiner*—Thorl Chea
*Attorney, Agent, or Firm*—Carl O. Thomas

[57] ABSTRACT

Novel tabular grain emulsions and a process for their preparation are disclosed in which silver bromoiodide tabular grains account for greater than 97 percent of total grain projected area and the coefficient of variation of the total grain population is less than 25 percent. This is achieved by forming in a first reaction vessel and transporting to a second reaction vessel a population of silver bromide grain nuclei in the form of regular octahedra having an equivalent circular diameter of less than 40 nanometers and a coefficient of variation of less than 50 percent and in the second reaction vessel converting the grain nuclei into a grain population containing parallel twin planes in more than 90 percent of the grains, so that upon further growth silver bromoiodide tabular grains of desired properties can be realized.

A photographic element is disclosed comprised of a support, a first silver halide emulsion layer responsive to minus blue (500 to 700 nm) light and a second silver halide emulsion layer positioned to overlie the first emulsion layer. In the second emulsion layer greater than 97 percent of the total projected area of grains having an equivalent circular diameter of at least 0.2 μm is accounted for by silver bromoiodide tabular grains having an average equivalent circular diameter of at least 0.7 μm and an average thickness of less than 0.07 μm.

13 Claims, 2 Drawing Sheets

PHOTOGRAPHIC ELEMENTS INCLUDING HIGHLY UNIFORM SILVER BROMOIODIDE TABULAR GRAIN EMULSIONS

This is a continuation-in-part of U.S. Ser. Nos. 679,712 and 679,714, both filed Apr. 3, 1991 both now abandoned.

FIELD OF THE INVENTION

The invention relates to silver halide photography. More specifically, the invention relates to tabular grain silver halide emulsions, processes for their preparation and photographic elements containing these emulsions.

BACKGROUND

Kofron et al U.S. Pat. No. 4,439,520 ushered in the current era of high performance silver halide photography. Kofron et al discloses chemically and spectrally sensitized high aspect ratio tabular grain emulsions in which tabular grains having a diameter of at least 0.6 μm and a thickness of less than 0.3 μm exhibit an average aspect ratio of greater than 8 and account for greater than 50 percent of total grain projected area. Kofron et al in column 11, lines 55 to 58 inclusive, states that the tabular grains typically have a thickness of at least 0.03 μm, but can in theory have thicknesses as low as 0.01 μm. Kofron et al in column 89, Table XVIII reports a series of tabular grain silver bromide emulsions having tabular grain thicknesses ranging from 0.07 to 0.12 μm and projected areas of greater than 95 percent of total grain projected area; however, in column 94, Table XXI a parallel preparation of tabular grain silver bromoiodide emulsions shows tabular grain thicknesses ranging from 0.08 to 0.11 μm, showing some thickening of the grains, and tabular grain projected areas as a percentage of total grain projected area are sharply reduced to just greater than 85 percent of total grain projected area. In column 15, line 50, Kofron et al states that emulsions having coefficients of variation of less than 30 percent can be prepared, but from FIG. 3 (showing a wide grain dispersity) and the numerous Example emulsions having tabular grain projected areas in the range of from just greater than 50 to just greater than 70 percent, it is apparent that for the most part the emulsions did not have coefficients of variation of less than 30 percent.

Kofron et al recognized that the tabular grain emulsions would produce both single and multiple emulsion layer photographic elements exhibiting improved photographic performance in terms of image structure (sharpness and granularity) and enhanced photographic speed as a function of image structure—e.g., an improved speed-granularity relationship. A series of multicolor photographic element layer order arrangements containing a high aspect ratio tabular grain emulsion in one or more layers is disclosed by Kofron et al in columns 56 to 58. In column 79, Table XII comparisons are provided of green and red image sharpness within multicolor photographic elements containing fast and slow blue light recording (yellow image dye forming), green light recording (magenta image dye forming) and red light recording (cyan image dye forming) emulsion layers containing various selections of nontabular grain emulsions set out in column 28, Table X, and tabular grain emulsions set out in column 28, Table XI. Note that while the tabular grain emulsions ranged from 0.06 to 0.19 μm in thickness, the percentage of tabular grain projected area did not range appreciably above 70 percent of total grain projected area.

A preferred technique employed by Kofron et al for the preparation of the high aspect ratio tabular grain silver bromide and bromoiodide emulsions is disclosed starting at column 13, line 15, and extending through column 16, line 48. Grain nucleation is preferably undertaken by the double jet precipitation of silver bromide grain nuclei that are substantially free of iodide in the pBr range of from 0.6 (preferably 1.1) to 1.6 (preferably 1.5). It is stated (col. 14, lines 15 to 19) that if the pBr of the dispersing medium is initially too high, the tabular grains will be comparatively thick. In the first paragraph of column 15 it is stated that instead of introducing silver, bromide and iodide as aqueous solutions initially or during the growth stage it is alternatively possible to introduce fine silver halide grains—e.g. grains having a mean diameter of less than 0.1 μm.

Kofron et al (col. 13, lines 42–50) suggests ultrafiltration during precipitation, as taught by Mignot U.S. Pat. No. 4,334,012. Mignot teaches a general process for the ultrafiltration of silver halide emulsions during precipitation that is equally applicable to tabular and nontabular grain emulsion precipitations. In its simplest form Mignot contemplates the nucleation and growth stages of silver halide precipitation occurring in the same reaction vessel. In column 14, line 21, through column 15, line 16, it is suggested to perform grain nucleation and growth in separate reaction vessels. Return of emulsion from the ultrafiltration unit to either the nucleation or growth reaction vessels is contemplated. Urabe U.S. Pat. No. 4,879,208, Verhille et al U.S. Pat. No. 4,171,224 and Forster et al U.S. Pat. No. 3,897,935, disclose grain nucleation upstream of a growth reaction vessel.

Several hundred scientific and patent publications have followed Kofron et al purporting to represent alternatives in terms of one or more tabular grain emulsion parameters and/or variations of processes for tabular grain emulsion preparation. Attention is specifically directed to the following:

Daubendiek et al U.S. Pat. No. 4,414,310 discloses high aspect ratio tabular grain emulsions prepared using silver iodide seed grains. Average tabular grain thicknesses as low as 0.06 μm are disclosed with tabular grain projected areas of just greater than 90 percent of total grain projected area. A high proportion of the tabular grains have hexagonal major faces.

*Research Disclosure*, Aug. 1983, Item 23212, discloses a process of preparing silver bromide high aspect ratio tabular grain emulsions in which the tabular grains account for at least 97 percent of total grain projected area and have an average thickness of at least 0.03 μm. In Example 1 at least 99 percent of the total grain projected area is accounted for by silver bromide tabular grains having an average thickness of 0.06 μm. The coefficient of variation of the emulsion is 15. *Research Disclosure* is published by Kenneth Mason Publications, Ltd., Emsworth, Hampshire P010 7DD, England. The tabular grains are prepared by a double jet precipitation to form seed grains followed by ripening in the absence of a nonsilver halide solvent. Ultrafiltration while forming the seed grains as taught by Mignot, cited above, is specifically taught.

Abbott et al U.S. Pat. No. 4,425,426 discloses thin, intermediate aspect ratio tabular grain emulsions in which tabular grains having thicknesses of less than 0.2 μm have average aspect ratios in the range of from 5 to 8. Tabular Grain Emulsion 1 exhibited an average tabular grain thickness of 0.09 μm with tabular grains accounting for just greater than 75 percent of total grain projected area.

Daubendiek et al U.S. Pat. No. 4,693,964 discloses that increased image sharpness can be achieved in an underlying minus blue recording silver halide emulsion layer of a multicolor photographic element when an overlying tabular grain emulsion layer is provided in which at least 50 percent of total grain projected area is accounted for by tabular grains having an average aspect ratio of greater than 8 and an average equivalent circular diameter of from 0.4 to 0.55 μm. A series of tabular grain emulsions are listed in Table I, column 22. From comparisons presented in the Examples it is taught that increasing the average equivalent circular diameter of the tabular grains in the overlying emulsion layer to a value of 0.64 μm, as illustrated by emulsion TC17, results in obtaining inferior image sharpness in the underlying emulsion layer. Thus, the teaching of Daubendiek et al is that a sharpness penalty is incurred in an underlying minus blue sensitized emulsion layer when the tabular grains in an overlying emulsion layer have an average equivalent circular diameter that exceed 0.55 μm. A remake of emulsion TC17 of Daubendiek et al appears in the Examples below as Control Emulsion TC12.

Maskasky U.S. Pat. No. 4,713,320 discloses that the proportion of unwanted grain shapes (principally rods) in tabular grain silver bromide or bromoiodide emulsions can be reduced by employing during precipitation a gelatino-peptizer containing less than 30 micromoles of methionine per gram. In column 14, Emulsion 8B, a silver bromoiodide emulsion is reported prepared in the presence of low methionine gelatin in which tabular grains having a mean diameter of 2.6 μm and a mean thickness of 0.071 μm account for more than 85 percent of total grain projected area.

Saitou et al U.S. Pat. No. 4,797,354 reports tabular grain emulsions in which a high proportion of the tabular grains have hexagonal major faces with a 2:1 or less ratio of adjacent edge lengths. Low coefficients of variation of the tabular grains are reported (not to be confused with customary and significantly higher coefficient of variation measurements based on emulsion total grain population). Although silver halide emulsions of varied halide compositions are disclosed, only silver bromide emulsions are reported in the Examples.

Zola and Bryant published European patent application 362699 A3 discloses silver bromoiodide tabular grain emulsions of reduced dispersity in which the average aspect ratio of the silver bromoiodide tabular grains divided by the coefficient of variation of the total silver bromoiodide grain population is greater than 0.7. Examples 5 to 7 inclusive disclose tabular grain silver bromoiodide emulsions in the average tabular grain thickness is less than 0.07 μm, with the lowest coefficient of variation reported for these emulsions being 38 percent. In Example 3 the tabular grains exhibited an average thickness of 0.12 and accounted for 88 percent of the total grain projected area, with the coefficient of variation of the total grain population being 23 percent.

RELATED PATENT APPLICATION

Tsaur et al U.S. Ser. No. 699,855, filed May 14, 1991, titled A VERY LOW COEFFICIENT OF VARIATION TABULAR GRAIN EMULSION, commonly assigned, now allowed, discloses a photographic emulsion containing a coprecipitated grain population exhibiting a coefficient of variation of less than 20 percent, based on total coprecipitated grains. Silver bromide and bromoiodide tabular grains are disclosed to have a mean thickness in the range of from 0.08 to 0.3 μm and a mean tabularity of greater than 8. Incorporated polyalkylene surfactants incorporated in the emulsions during their precipitation act both to decrease grain dispersity and to thicken the tabular grains.

SUMMARY OF THE INVENTION

In one aspect this invention is directed to a process of preparing a tabular grain silver bromoiodide emulsion of high grain uniformity in which greater than 97 percent of total grain projected area is accounted for by tabular grains and the coefficient of variation of the total grain population is less than 25 percent comprising (A) precipitating in a first reaction vessel and transporting to a second reaction vessel silver bromide grain nuclei as regular octahedra having a mean equivalent circular diameter of less than 40 nanometers and a coefficient of variation of less than 50 percent, (B) converting the silver bromide grain nuclei in the second reaction vessel to a grain population in which more than 90 percent of the grains silver bromide grain population containing parallel twin planes into silver bromoiodide tabular grains having an average aspect ratio of greater than 5.

In another aspect this invention is directed to an emulsion containing a dispersing medium and a coprecipitated population of grains including silver bromoiodide tabular grains containing parallel twin planes and having an average aspect ratio of greater than 5. The emulsion is characterized in that greater than 97 percent of the total projected area of said grain population is accounted for by the silver bromoiodide tabular grains and the coefficient of variation of the grain population is less than 25 percent.

In an additional aspect the invention is directed to a photographic element comprised of a support, a first silver halide emulsion layer coated on the support and sensitized to produce a photographic record when exposed to specular light within the minus blue visible wavelength region of from 500 to 700 nm, a second silver halide emulsion layer capable of producing a second photographic record coated over the first silver halide emulsion layer to receive specular minus blue light intended for the exposure of the first silver halide emulsion layer, the second silver halide emulsion layer being capable of acting as a transmission medium for delivery of at least a portion of the minus blue light intended for the exposure of the first silver halide emulsion layer in the form of specular light, the second silver halide emulsion layer being comprised of a dispersing medium and silver halide grains including tabular grains having {111} major faces. The photographic element is characterized in that greater than 97 percent of the total projected area of the silver halide grains having an equivalent circular diameter of at least 0.2 μm of the second emulsion layer is accounted for by silver bromoiodide tabular grains having an average equivalent circular diameter of at least 0.7 μm and an average thickness of less than 0.07 μm.

DESCRIPTION OF PREFERRED EMBODIMENTS

Figure 1:
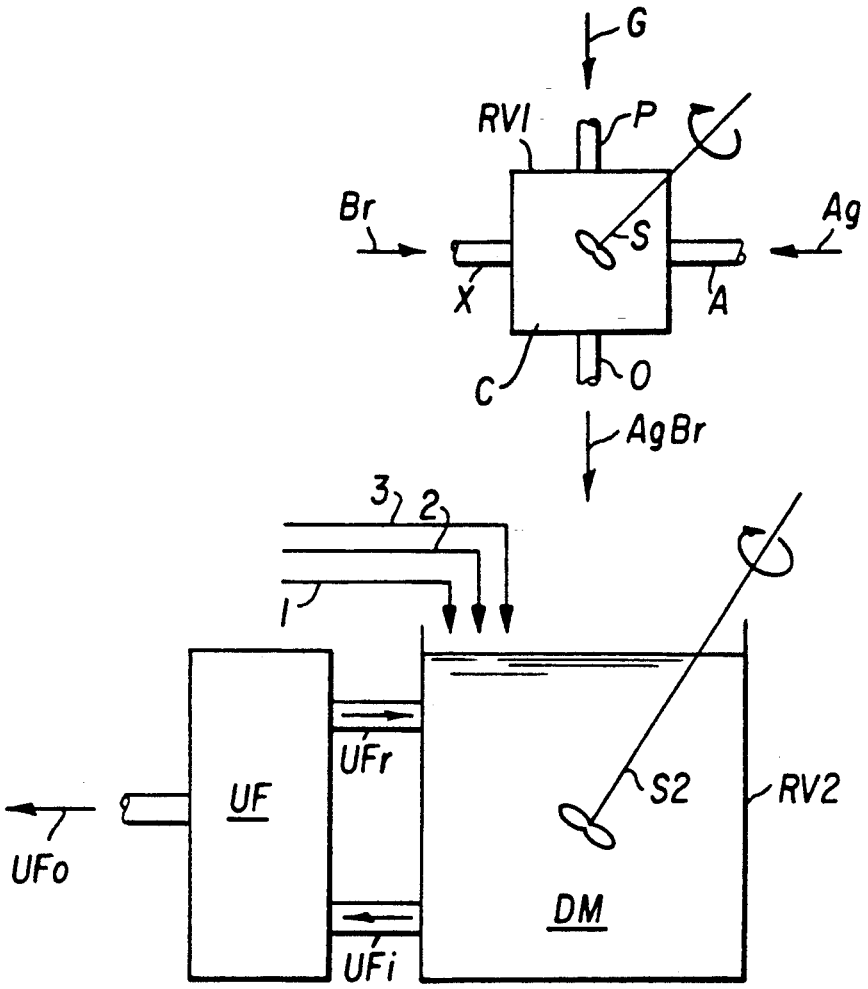
FIG. 1 is a schematic diagram of a two reaction vessel arrangement for emulsion precipitation.

Broadly encompassed within the purview of this invention are tabular grain silver bromoiodide emulsions, processes for their preparation and multilayer photographic elements containing these emulsions.

In one specific aspect the invention is directed to tabular grain silver bromoiodide emulsions comprised of a dispersing medium and a coprecipitated population of grains including silver bromoiodide tabular grains having an average aspect ratio of greater than 5. Greater than 97 percent of the total projected area of the coprecipitated grain population is accounted for by the silver bromoiodide tabular grains and the coefficient of variation of the coprecipitated grain population is less than 25.

No tabular grain silver bromoiodide emulsion has heretofore existed in the art in which silver bromoiodide tabular grains have accounted for such a high proportion of the total projected area of the coprecipitated grain population and the total coprecipitated grain population has exhibited such a low coefficient of variation. In specifically preferred forms of the invention tabular grains can account for greater than 99 percent of the total projected area of coprecipitated tabular grains. Further, the coefficient of variation of the coprecipitated silver bromoiodide grains can be less than 20 percent.

As employed herein the term "tabular grain" refers to grains having two parallel major faces that appear hexagonal or triangular. The major faces of such tabular grains generally lie in {111} crystallographic planes and it is generally accepted that the tabular shape is attributable to the presence of at least two (and occasionally three or more) parallel twin planes oriented parallel to their major faces.

In one specifically preferred form of the invention greater than 90 percent of the coprecipitated silver bromoiodide tabular grains have hexagonal major faces—that is, the ratio of adjacent major face edge lengths is less than 2. A high proportion of tabular grains with hexagonal major faces is an indication of grain uniformity in twinning, since a tabular grain with hexagonal faces results from early introduction of an even number of parallel twin planes (almost always 2) whereas tabular grains with triangular major faces contain an odd number of parallel twin planes (almost always 3). Thus, a tabular grain population having an equal mix of tabular grains with hexagonal and triangular major faces indicates nonuniformity in twinning.

As employed herein the terms "coefficient of variation" and "COV" are employed in their art recognized usage to indicate 100 times the standard deviation of grain diameter divided by the average grain diameter. Grain diameter is the diameter of a circle having an area equal to the projected area of the grain and is also referred to as "equivalent circular diameter" or "ECD".

Photographic advantages are generally realized for any combination of average tabular grain ECD and thickness (t) capable of providing an average aspect ratio (ECD/t) of at least 5. Preferred emulsions are those in which the average aspect ratio ranges from greater than 8 up to 100 or more, with average aspect ratios in the range of from 10 to 60 generally offering an optimum practical balance of preparation convenience and photographic performance.

Unexpected advantages, discussed in detail below, have been realized for tabular grain emulsions having ECD's of at least 0.7 μm. Although emulsions with extremely large average grain ECD's are occasionally prepared for scientific grain studies, for photographic application ECD's are conventionally limited to less than 10 μm and in most instances are less than 5 μm. An optimum ECD range for moderate to high camera speed photographic emulsions of high image structure quality is in the range of from 1 to 4 μm.

The average tabular grain thickness of the emulsions of the invention can take any value satisfying the average ECD and aspect ratio ranges set out above. Average tabular grain thicknesses of less than 0.3 μm are preferred for all but unusual photographic applications (note Kofron et al, cited above, column 11, lines 53 to 65). Specifically preferred tabular grain emulsions according to the invention are thin tabular grain emulsions—i.e., emulsions in which the silver bromoiodide tabular grains have an average thickness of less than 0.2 μm.

In a specifically preferred form, the invention is directed to ultrathin tabular grain emulsions—i.e., emulsions in which the silver bromoiodide tabular grains have an average thickness of less than 0.07 μm. The procedures for preparation of ultrathin tabular grain emulsions herein disclosed offer the capability of producing emulsions having average silver bromoiodide tabular grain thicknesses ranging to 0.01 μm. Specifically preferred ultrathin tabular grain emulsions according to the invention are those in which the silver bromoiodide tabular grains have average thicknesses in the range of from 0.02 to less than 0.05 μm. Ultrathin tabular grain emulsions offer a wide range of photographic advantages, including rapid processing, low granularity as a function of silver coverage, high minus blue (500 to 700 nm exposure) speeds and increased separation of blue and minus blue speeds (resulting in minimizing blue exposure contamination of minus blue photographic records).

As applied to the grains and emulsions referred to in the description of the invention, the term "silver bromoiodide" indicates a silver halide composition that consists essentially of bromide ion and at least 0.1 mole percent iodide, based on silver, an iodide amount sufficient to reach detectable threshold levels of iodide incorporation advantages. Conversely, the term "silver bromide" designates a silver halide composition that consists essentially of bromide as the halide ion, with iodide being maintained at a photographically negligible level of less than 0.1 mole percent, based on silver.

Any conventional iodide level can be present in the silver bromoiodide tabular grain emulsions of this invention. It is generally accepted that iodide has a solubility limit in silver bromide of about 40 mole percent (depending on the temperature of precipitation) based on silver. However in photographic use iodide levels in silver bromoiodide emulsions seldom exceed 20 mole percent, with iodide incorporation ranges of 0.5 to 12 mole percent being preferred for most photographic applications. For rapid access (less than 90 second) processing applications it is generally preferred to limit iodide levels to less than about 4 mole percent, preferably less than 3 mole percent. On the other hand, for multicolor photographic element applications in which iodide ion release during processing produces useful interimage effects, iodide levels in the 4 to 12 mole percent range are typical. Silver bromoiodide emulsions are almost universally employed in moderate and high speed photographic films, since the presence of even small amounts of iodide offer the advantage of improved speed (more accurately, an improved speed-granularity relationship).

While *Research Disclosure* Item 23212, cited above, partially realized the levels of tabular grain uniformity described above, the procedure is limited to the preparation of silver bromide emulsions and is also unattractive for commercial use because of the extended ripening periods required. Kofron et al, cited above, corroborates iodide incorporation as degrading tabular grain emulsion uniformity.

An important aspect of the present invention has been development of a novel process for preparing high uniformity silver bromoiodide tabular grain emulsions. One of the discoveries that has contributed to the present invention is that tabular grain emulsion uniformity is enhanced by precipitating in one reaction vessel silver bromide grain nuclei that are crystallographically regular (i.e., internally free of defects such as twin planes or screw dislocations) while restricting the size and dispersity of grain nuclei and then transferring to a second reaction vessel to introduce into the silver bromide grain nuclei the parallel twin planes required for tabular grain formation. This runs exactly counter to the overwhelming majority of silver bromoiodide tabular grain emulsion preparations, which attempt concurrent grain nuclei formation and parallel twin plane introduction, based on the generally accepted assumption that the thinnest possible tabular grain population is realized when grain nucleation occurs under conditions that promote immediate twinning.

The first step of the novel process for preparing high uniformity silver bromoiodide tabular grain emulsions according to this invention is to precipitate a grain population consisting essentially of silver bromide grain nuclei as regular octahedra having an ECD of less than 40 (preferably less than 30 and optimally less than 20) nanometers. The coefficient of variation of the silver bromide grain nuclei is preferably less than 50 percent, most preferably less than 30 percent and optimally less than 20 percent. Because of the exceedingly small ECD's of the grain nuclei, even large COV values do not amount to large numerical variances in ECD's. Hence, larger COV's can be tolerated in the grain nuclei than in the tabular grains of the completed emulsion.

Any conventional precipitation technique capable of producing the required silver bromide grain nuclei population described above can be employed. A preferred arrangement for silver bromide grain nuclei precipitation is schematically shown in FIG. 1. A first reaction vessel RV1 is provided in the form of a double jet continuous reactor. The term "double jet" is employed in its art recognized sense as referring to introducing silver and halide ion concurrently (usually through 2 or 3 separate jets) during precipitation as opposed to "single jet", employed in the art to describe precipitations that add silver ion, but not halide ion. The continuous double jet reactor RV1 is provided with a chamber C and three input jets A, X and P. Silver ion, indicated by arrow Ag, is introduced into the chamber through jet A in the form of an aqueous silver salt solution, typically a silver nitrate solution. Bromide ion, indicated by arrow Br, is introduced into the chamber through jet X in the form of an aqueous bromide salt solution, typically a sodium or potassium bromide solution. An aqueous gelatino-peptizer dispersion, indicated by arrow G, is introduced into the chamber through jet P. A rotating stirring mechanism S is present in the chamber and is relied upon to maintain an essentially uniform composition within the chamber. Dispersing medium (soluble salts, water and gelatino-peptizer) and silver bromide grain nuclei, indicated by arrow AgBr, are removed from the chamber through outlet O. For simplicity conventional controls, such as a valves, silver and reference electrodes, thermal sensors, etc., are not shown.

To prepare the silver bromide grain nuclei employed in the practice of the invention, the reactor RV1 is first brought to a steady state operating condition with all jets and the outlet open. That is, precipitation is conducted until the AgBr output becomes invariant before it is used for tabular grain emulsion preparation.

The gelatino-peptizer within the chamber is maintained at a concentration in the range of from 0.5 to 3 grams per liter. Any conventional gelatino-peptizer can be employed, including gelatin—e.g., alkali-treated gelatin (cattle or hide gelatin) or acid-treated gelatin (pigskin gelatin) or gelatin derivatives—e.g., acetylated gelatin and phthalated gelatin. Conventional gelatino-peptizers are summarized in *Research Disclosure*, Vol. 308, Dec. 1989, Item 308119, Section IX. Preferred gelatino-peptizers are low methionine gelatino-peptizers—that is, those containing less than 30 micromoles per gram (preferably less than 12 micromoles per gram) methionine. While a few naturally occurring sources of gelatin contain low levels of methionine, Maskasky U.S. Pat. No. 4,713,320 teaches methionine reduction by oxidation and King et al U.S. Pat. No. 4,942,120 teaches methionine reduction by alkylation. The disclosures of both are here incorporated by reference.

By adjusting of the silver jet A and the halide jet X the pBr of the dispersing medium within the chamber C is maintained in a range that produces regular silver bromide octahedra and does not favor the incorporation of twin planes in the silver bromide grain nuclei. To accomplish this it is preferred to maintain the dispersing medium in the chamber within the pBr of in the range of from 2.1 to 3 and within the temperature range of 30° to 50° C.

To obtain silver bromide grain nuclei within the size and dispersity ranges set out above it is additionally necessary to limit the duration which the silver bromide grain nuclei remain in the chamber C. It is contemplated to operate the continuous double jet reactor RV1 at the minimum conveniently attainable residence time. Residence times of from 0.5 to 5 seconds and, preferably from 1 to 3 seconds, are contemplated. The term "residence time" is employed in its art recognized usage to mean the liquid volume of the reaction vessel divided by the rate (volume per second) at which output emulsion AgBr is removed at a steady state operating condition.

The output emulsion AgBr, containing the regular octahedra silver bromide grain nuclei and dispersing medium, is fed directly from the first reaction vessel RV1 into a second reaction vessel RV2. In the second reaction vessel the regular silver bromide grain nuclei are converted into a silver bromide grain population containing parallel twin planes. At least 90 percent of the grain population produced in the second reaction vessel contains parallel twin planes. After the twinned grain population is produced, the silver bromoiodide emulsions of the invention can be produced by additional silver, bromide and iodide ion introduction in the second reaction vessel (or, if desired, in a third reaction vessel) to produce the high uniformity silver bromoiodide tabular grain emulsions of this invention.

To minimize initial transient conditions within the second reaction vessel upon receipt of the silver bromide grain nuclei, the contents of the second reaction vessel are, prior to receipt of the silver bromide grain nuclei adjusted to at least approximate optimum conditions for receipt of the grain nuclei. In a preferred mode of operation the second reaction vessel prior to receiving silver bromide grain nuclei from the first reaction vessel is provided with a dispersing medium DM containing water, gelatino-peptizer conforming to the concentration ranges set forth above and sufficient bromide ion to maintain the desired initial pBr level in the dispersing medium, and the temperature of the dispersing medium is brought to the level desired upon grain nuclei receipt.

In a specifically preferred mode of operation the volume of the dispersing medium DM in the second reaction vessel is regulated to minimize variance following receipt of the silver bromide grain nuclei. Preferably the contents volume of the second reaction vessel varies by less than 20 percent and, optimally, less than 10 percent in the formation of the silver bromoiodide tabular grain emulsions of this invention.

A preferred mode of minimizing liquid volume variance in the second reaction vessel during emulsion preparation is achieved by coupling to the second reaction vessel and commencing operation of an ultrafiltration unit UF (e.g., a unit of the type described by Mignot U.S. Pat. No. 4,334,012 or Brown et al U.S. Pat. No. 4,336,328) prior to receipt of the silver bromide grain nuclei. The ultrafiltration unit takes in a portion of the dispersing medium, as indicated by arrow UFi, selectively discards a portion of the water and soluble salts (e.g., alkali cations and bromide anions) received, as indicated by arrow UFo, and returns the balance of the dispersing medium to the second reaction vessel, as indicated by arrow UFr. Whatever is initially discarded can be replenished through one or more of the input jets 1, 2 and 3 so that the composition of the dispersing medium DM remains invariant prior to receipt of silver bromide grain nuclei. A stirring mechanism S2 is shown in the second reaction vessel to assist in maintaining dispersing medium uniformity.

In one contemplated mode of operation twinning of the silver bromide grain nuclei received from the first reaction vessel is commenced immediately upon delivery to the second reaction vessel. In this mode of operation the second reaction vessel is preferably maintained while silver bromide grain nuclei are being received in the same temperature range as the first reaction vessel.

To introduce twin planes into the silver bromide grain nuclei upon receipt in the second reaction vessel a higher stoichiometric excess of bromide ion is required in the second reaction vessel than the first reaction vessel. The higher excess bromide ion concentration also acts as a silver bromide solvent, accelerating ripening out (dissolution) of untwinned grains that would otherwise tend to remain and grow as nontabular grains. To perform the necessary twinning function it is contemplated to maintain a pBr of from 1.1 to 2.0 in the second reaction vessel during this step. The contents of second reaction vessel are held at a temperature of from 30° to 50° C. and a pBr of from 1.1 to 2.0 for a period of from 5 second to 5 minutes, preferably 30 seconds to 3 minutes, after delivery of silver bromide grain nuclei from the first reaction vessel is completed.

The twinning step will not in itself produce a grain population in which greater than 90 percent of the grains contain parallel twin planes. To complete the conversion to this desired grain population it is necessary to follow the twinning step with a ripening step. While maintaining the pBr range of the twinning step, the temperature of the emulsion is raised to the range of from >50°to 90° C. (preferably 60° to 80° C.) and held at this temperature for a period of from 3 to 30 minutes, preferably 5 to 20 minutes.

Although the process described above is capable of producing ultrathin (<0.07 μm mean thickness) tabular grains, an alternative approach has been discovered capable of producing even thinner tabular grains (<0.05 μm) and capable of facilitating the preparation of all silver bromoiodide ultrathin tabular grain emulsions according to this invention. In this alternative approach conversion of the silver bromide grain nuclei to a grain population in which more than 90 percent of the grains contain parallel twin planes is delayed until a major portion (preferably all) of the silver bromide grain nuclei required for the emulsion preparation have been received from the first reaction vessel and the conversion step, once commenced, is undertaken at a higher temperature (preferably from >50° to 90° C. and optimally at a constant temperature within this range) than when twinning is commenced immediately upon receipt of the silver bromide grain nuclei.

During the interim period while silver bromide grain nuclei are being received and before commencing the conversion step, the silver bromide grain nuclei are preserved. That is, the silver bromide grain nuclei are held under nontwinning and nonripening conditions that maintain the silver bromide grain nuclei population in essentially the same size-frequency distribution (dispersity) and untwinned (regular) form in which they are delivered from the first reaction vessel. Silver bromide ripening is a minimum when the pBr of the dispersing medium containing the silver bromide grain nuclei is maintained at the minimum solubility of silver bromide. It is preferred during this step, hereinafter referred to as the preservation step, to restrict the pBr of the dispersing medium to a range that holds the solubility of silver bromide to less than 10 percent (optimally less than 5 percent) of its minimum value at the temperature of operation. Silver bromide solubility minima at various conventional precipitation temperatures are known to those skilled in the art, as illustrated by Daubendiek et al U.S. Pat. No. 4,914,014, the disclosure of which is here incorporated by reference.

Since the preservation step is of short duration and is followed immediately by the conversion (twinning and ripening) step, the preservation step is preferably also undertaken at the >50° to 90° C. temperature of the twinning step. This offers the advantage of allowing the second reaction vessel to be operated at a single temperature.

The preservation step extends for whatever time period is required to deliver the silver bromide grain nuclei to the second reaction vessel. The preservation step conveniently extends over a time period of from 5 seconds to 5 minutes, with a time period of from 30 seconds to 3 minutes being typical.

Since the conversion step that follows the preservation step is conducted at a higher temperature than the twinning step described above that commences immediately upon deliver of silver bromide grain nuclei to the first reactor, an adjustment of pBr values to reflect the higher temperature is required. For the conversion step following the preservation step it is preferred to maintain the pBr in the range of from 1.1 to 2.1. The conversion step in this instance has a total duration of at least 2 minutes, preferably 3 minutes. While conversion times can be extended for up to 30 minutes, for ultrathin tabular grain thicknesses of less than 0.05 μm, it is preferred that the conversion step be completed in 10 minutes or less.

After a silver bromide grain population has been produced containing parallel twin planes, growth of the twinned grain population to produce silver bromoiodide tabular grains of high uniformity according to this invention can be accomplished by employing any convenient conventional procedure for growing silver bromoiodide tabular grains without renucleation and with minimal thickening of the tabular grains. Exemplary teachings are provided by Kofron et al U.S. Pat. No. 4,439,520; Wilgus et al U.S. Pat. No. 4,434,226; Daubendiek et al U.S. Pat. No. 4,414,310; Solberg et al U.S. Pat. No. 4,433,048; Maskasky U.S. Pat. No. 4,713,320; and Daubendiek et al U.S. Pat. No. 4,914,014, the disclosures of which are here incorporated by reference.

Referring to FIG. 1, the growth step can in one contemplated form be accomplished by introducing a mixture of bromide and iodide ions through jet 1, silver ions through jet 2, and additional peptizer and water, if desired, through jet 3. Alternatively, bromide and iodide ion can be introduced through separate jets, optionally increasing the number of jets to four. When silver and halide ions are introduced through separate jets, they are typically provided in the form of soluble salts, such as alkali halide salts in one or more aqueous solutions and silver nitrate in a separate aqueous solution.

Instead of introducing silver and halide ion through separate jets it is recognized that silver and halide ions can be introduced through the same jet. In this instance the silver and halide ions form silver halide grains. So long as the mean (optimally the maximum) ECD of the silver halide grains is maintained small, typically less than about 0.1 μm, their rate of dissolution in the dispersing medium during the growth step is sufficiently high that none survive to reduce final emulsion grain uniformity. It is specifically contemplated to supply either silver bromide or silver bromoiodide grains having an ECD of less than 0.1 μm and preferably less than 0.04 μm to the second reaction vessel from the first reaction vessel during the growth step. It is immaterial whether the grains supplied during the growth step are regular or irregular, but no large grains can be tolerated. For example, an ideal silver halide grain population to serve as a source of silver and halide ion during grain growth is a Lippmann emulsion.

During the growth step the choice of and concentration of peptizers in the second reaction vessel can take any convenient conventional form. It is well known to increase peptizer levels during tabular grain growth.

It has been recognized quite unexpectedly that superior results are obtained in preparing silver bromoiodide ultrathin tabular grain emulsions according to this invention when low methionine gelatino-peptizers are employed in the first reaction vessel and, optimally, both reaction vessels. It has further been observed that superior silver bromoiodide ultrathin tabular grain emulsions result when fine grain silver bromoiodide emulsions as described above rather than soluble silver and halide salts are supplied to the second reaction vessel during the growth step.

Aside from the features of the preferred silver bromoiodide tabular grain emulsions and their preferred procedure for preparation specifically described, the emulsions of this invention and their preparation can take any desired conventional form. For example, all stages of emulsion precipitation described above can be conducted within conventional pH ranges, typically 1.5 to 7, preferably 3 to 6. Although not essential, it is specifically contemplated to incorporate ionic dopants in the tabular grains as taught by *Research Disclosure* Item 308119, cited above, Section I, Paragraph D, the disclosure of which is here incorporated by reference. Further, in accordance with conventional practice, after a novel emulsion satisfying the requirements of the invention has been prepared, it can be blended with one or more other novel emulsions according to this invention or with any other conventional emulsion. Conventional emulsion blending is illustrated in *Research Disclosure* Item 308119, cited above, Section I, Paragraph I, the disclosure of which is here incorporated by reference.

The emulsions once formed can be further prepared for photographic use by any convenient conventional technique. Additional conventional features are illustrated by *Research Disclosure* Item 308119, cited above, Section II, Emulsion washing; Section III, Chemical sensitization; Section IV, Spectral sensitization; Section VI, Antifoggants and stabilizers; Section VII, Color materials; Section VIII, Absorbing and scattering materials; Section IX, Vehicles and vehicle extenders; X, Hardeners; XI, Coating aids; and XII, Plasticizers and lubricants; the disclosure of which is here incorporated by reference. The features of VII–XII can alternatively be provided in other photographic element layers The novel silver bromoiodide tabular grain emulsions of this invention can be employed in any otherwise conventional photographic element. The emulsions can, for example, be included in a photographic element with one or more silver halide emulsion layers. In one specific application a novel emulsion according to the invention can be present in a single emulsion layer of a photographic element intended to form either silver or dye photographic images for viewing or scanning. The term "photographic element" is employed in its art recognized usage as encompassing radiographic elements, particularly those intended to be exposed by one or more intensifying screens.

In one important aspect this invention is directed to a photographic element containing at least two superimposed radiation sensitive silver halide emulsion layers coated on a conventional photographic support of any convenient type. Exemplary photographic supports are summarized by *Research Disclosure*, Item 308119, cited above, Section XVII, here incorporated by reference. The emulsion layer coated nearer the support surface is spectrally sensitized to produce a photographic record when the photographic element is exposed to specular light within the minus blue portion of the visible spectrum The term "minus blue" is employed in its art recognized sense to encompass the green and red portions of the visible spectrum—i.e., from 500 to 700 nm. The term "specular light" is employed in its art recognized usage to indicate the type of spatially orientated light supplied by a camera lens to a film surface in its focal plane—i.e., light that is for all practical purposes unscattered.

The second of the two silver halide emulsion layers is coated over the first silver halide emulsion layer. In this arrangement the second emulsion layer is called upon to perform two entirely different photographic functions. The first of these functions is to absorb at least a portion of the light wavelengths it is intended to record. The second emulsion layer can record light in any spectral region ranging from the near ultraviolet (≧300 nm) through the near infrared (<1500 nm). In most applications both the first and second emulsion layers record images within the visible spectrum The second emulsion layer in most applications records blue or minus blue light and usually, but not necessarily, records light of a shorter wavelength than the first emulsion layer Regardless of the wavelength of recording contemplated, the ability of the second emulsion layer to provide a favorable balance of photographic speed and image structure (i.e., granularity and sharpness) is important to satisfying the first function The second distinct function which the second emulsion layer must perform is the transmission of minus blue light intended to be recorded in the first emulsion layer. Whereas the presence of silver halide grains in the second emulsion layer is essential to its first function, the presence of grains, unless chosen as required by this invention, can greatly diminish the ability of the second emulsion layer to perform satisfactorily its transmission function. Since an overlying emulsion layer (e.g., the second emulsion layer) can be the source of image unsharpness in an underlying emulsion layer (e.g., the first emulsion layer), the second emulsion layer is hereinafter also referred to as the optical causer layer and the first emulsion is also referred to as the optical receiver layer.

Figure 2:
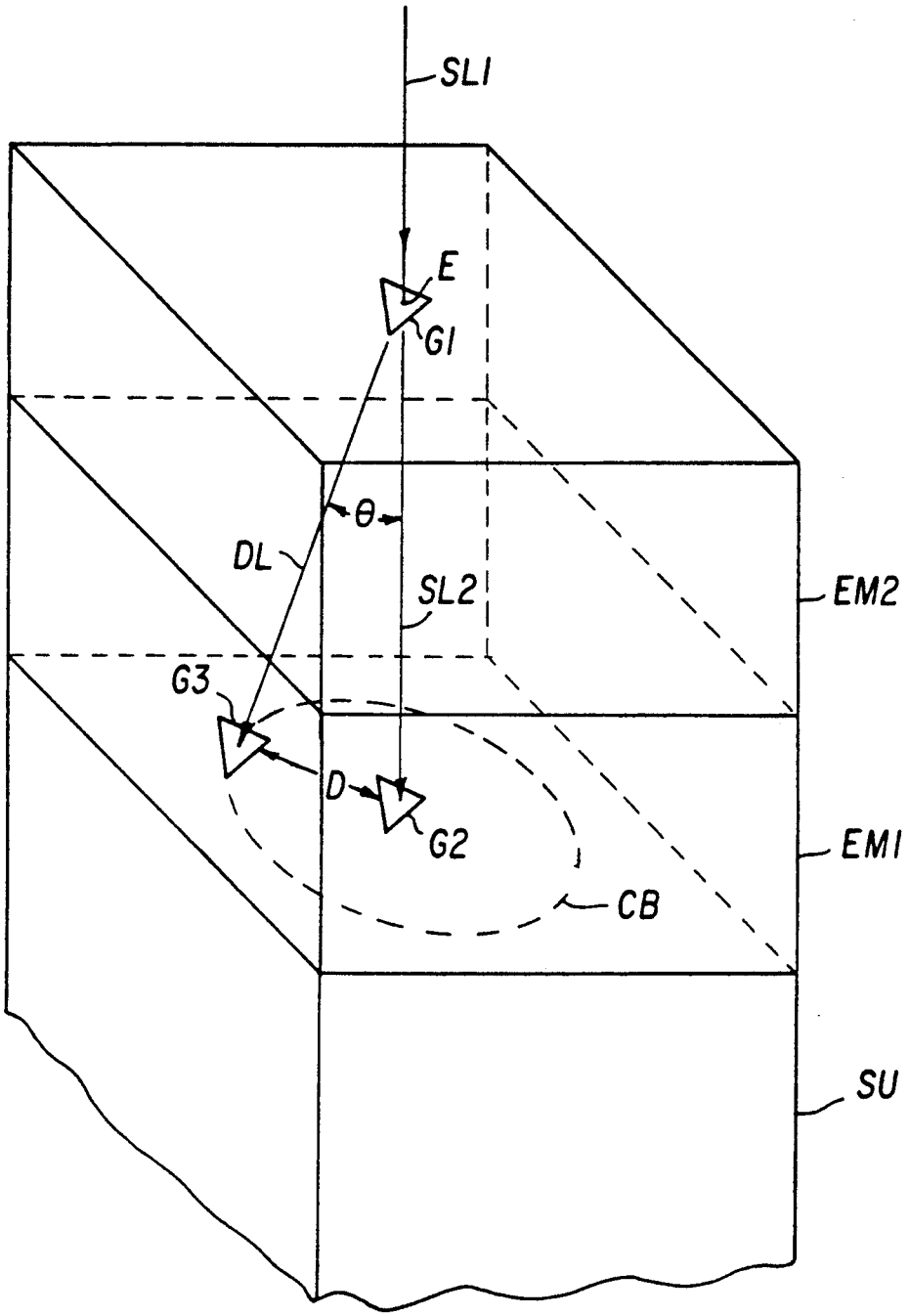
FIG. 2 is a schematic diagram of a photographic element.

How the overlying (second) emulsion layer can cause unsharpness in the underlying (first) emulsion layer can be visualized by reference to FIG. 2, wherein a detail of a support SU, a first emulsion layer EM1 and a second emulsion layer EM2 are shown. Specular light, indicated by arrow SL1, enters the second emulsion layer at E and encounters a silver halide grain G1. Any one of three different events can happen at G1, the light can be absorbed by the grain, specularly transmitted through the grain and beyond, as indicated by arrow SL2, or laterally deflected, as indicated by arrow DL. When the light continues along the path SL2 into the first emulsion layer, it will, in most instances, encounter a grain in that layer, indicated as G2. Absorption of light by grain G2 contributes to forming a sharp image in the first emulsion layer. However, if the light is instead deflected by at an angle $\theta$ along path DL and strikes a grain, shown as G3, laterally offset from grain G2 by a distance D, the component of the photographic record produced by grain G3 is a spatially inaccurate representation of the specular image supplied to the film, and the result is an image of less than ideal sharpness. Notice that it is not the direction, but the angle of deflection that is important. Sharpness degradation is determined by the deflection angle $\theta$ that in turn controls the distance of deflection for a given layer thickness. If arrow DL is rotated around axis SL2 while maintaining deflection angle $\theta$ constant, a collection cone is created having a base CB.

Though useful for visualizing scattering as a single event, the schematic diagram in FIG. 2 is simplistic, since both emulsion layers actually contain very large numbers of grains and light seldom traverses any appreciable distance without striking a grain and in the overwhelming majority of instances strikes many grains, often being deflected many times at widely varying angles before absorption. In methods of quantifying the specularity of light transmission through an emulsion layer all of the light transmitted through the emulsion layer is received and recorded using an integrating sphere. The total transmitted light is then compared with the portion of the light transmitted within a collection cone having an angle $\theta$ of a selected value. In the Examples below a collection cone angle of 7° has been selected and all transmitted light within the corresponding collection cone is considered to have been specularly transmitted. A more detailed description of specularity measurement is provided by Kofron et al, cited above.

It has been discovered that a favorable combination of photographic sensitivity and image structure (e.g., granularity and sharpness) are realized when greater than 97 percent, preferably greater than 99 percent, of the total projected area of the silver halide grains having an ECD of greater than 0.2 μm in the second emulsion is accounted for by silver bromoiodide tabular grains having an average equivalent circular diameter of at least 0.7 μm and an average thickness of less than 0.07 μm, preferably less 0.05 μm.

Except for the possible inclusion of grains having an ECD of less than 0.2 μm (hereinafter referred to as optically transparent grains), the second emulsion layer consists almost entirely of silver bromoiodide ultrathin tabular grains The optical transparency to minus blue light of grains having ECD's of less 0.2 μm is well documented in the art. For example, Lippmann emulsions, which have typical ECD's of from less than 0.05 μm to greater than 0.1 μm, are well known to be optically transparent. Grains having ECD's of 0.2 μm exhibit significant scattering of 400 nm light, but limited scattering of minus blue light. In a specifically preferred form of the invention the tabular grain projected areas of greater than 97% and optimally greater than 99% of total grain projected area are satisfied excluding only grains having ECD's of less than 0.1 (optimally 0.05) μm. Thus, in the photographic elements of the invention, the second emulsion layer can consist essentially of silver bromoiodide tabular grains or a blend of tabular grains as noted and optically transparent grains. When optically transparent grains are present, they are preferably limited to less than 10 percent and optimally less than 5 percent of total silver in the second emulsion layer.

The advantageous properties of the photographic elements of the invention depend on selecting the grains of the emulsion layer overlying a minus blue recording emulsion layer to have a specific combination of grain properties. First, the tabular grains are silver bromoiodide grains. The iodide content imparts art recognized advantages over comparable silver bromide emulsions in terms of speed and, in multicolor photography, in terms of interimage effects. Second, having an extremely high proportion of the total grain population as defined above accounted for by the tabular grains offers a sharp reduction in the scattering of minus blue light when coupled with an average ECD of at least 0.7 μm and an average grain thickness of less than 0.07 μm. The mean ECD of at least 0.7 μm is, of course, advantageous apart from enhancing the specularity of light transmission in allowing higher levels of speed to be achieved in the second emulsion layer. Finally, employing ultrathin tabular grains makes better use of silver and allows lower levels of granularity to be realized.

It is preferred, but not required, that the tabular grain population have the highest conveniently attainable level of tabular grain uniformity. It is specifically preferred that the tabular grains in the second emulsion layer have a COV less than 25 percent and optimally less than 20 percent. In one specifically preferred form of the invention greater than 90 percent of the tabular grains in the second emulsion layer have hexagonal major faces, thereby demonstrating a high degree of uniformity in twinning. It is specifically contemplated to incorporate the novel emulsions of this invention in at least the second emulsion layer of each photographic element of this invention.

In one simple form the photographic elements can be black-and-white (e.g., silver image forming) photographic elements, including radiographic elements in which the underling (first) emulsion layer is orthochromatically or panchromatically sensitized.

In an alternative form the photographic elements can be multicolor photographic elements containing blue recording (yellow dye image forming), green recording (magenta dye image forming) and red recording (cyan dye image forming) layer units in any coating sequence. A wide variety of coating arrangements are disclosed by Kofron et al, cited above, columns 56–58, the disclosure of which is here incorporated by reference.

EXAMPLES

The invention can be better appreciated by reference to following specific examples of emulsion preparations, emulsions and photographic elements satisfying the requirements of the invention.

EXAMPLES 1 TO 5 INCLUSIVE

These Examples demonstrate novel emulsions satisfying the requirements of the invention.

EXAMPLE 1

Nucleation

AgBr grain nuclei were generated in a continuous stirred tank reactor (a reactor of the type described above as RV1 commonly referred by the acronym CSTR) at a pBr of 2.3 and 40° C., 2 g/L gelatin (lime-processed, deionized, bone gelatin), 0.003M suspension density, and an average residence time of 3 seconds. This was carried out by mixing at steady state in the CSTR reactor a gelatin solution (2.4 g/L, 500 mL/min.) with a NaBr solution (0.47M, 50 mL/min.) and a silver nitrate solution (0.40M, 50 mL/min.). In this step the CSTR reactor was used to form the initial grain nuclei.

Twinning

These grain nuclei were transferred to a semi-batch reactor. The nucleation time comprising of grain nuclei formation and twinning is 1 minute. Initially, the semi-batch reactor was at a pBr of 1.3 and 40° C., 2 g/L gelatin (lime-processed, deionized, bone gelatin), 4.5 pH, and a total volume of 3 L. During the grain nuclei transfer, the semi-batch reactor was maintained at a pBr of 1.3 and 40° C. by controlled addition of a NaBr solution. In this step the semi-batch reactor was used to produce equivalent twinning. In the absence of this step, the population of the tabular grains was drastically reduced.

Transition

After the nuclei from the CSTR reactor were added to the semi-batch reactor, the temperature in the reactor was raised to 75° C. over a period of 4 minutes at the same pBr of 1.3. The temperature increase was followed by a hold time of 8 minutes. Subsequently, a lime-processed, deionized, bone gelatin solution (at 4.5 pH) was dumped in the semi-batch reactor to bring the total volume of the semibatch reactor to 6 L and the gelatin concentration to 10 g/L. The temperature of the semi-batch reactor was then decreased to 70° C. over 5 minutes. At this time the pBr of the semi-batch reactor was 1.5. In this step the semi-batch reactor was used for ripening of the tabular grains formed by the twinning process.

Growth

Growth was carried out by adding a 1.5M silver nitrate solution and a 1.5M mixed NaBr and KI solution (3% iodide) to the semi-batch reactor. The silver nitrate solution flow rate was ramped from 8 to 17 mL/min. in 10 minutes, from 17 to 33 mL/min. in 10 minutes, from 33 to 100 mL/min. in 25 minutes, and was then kept constant at 100 mL/min. until 3.8 moles of AgBrI (3% iodide) were precipitated. Single-jet precipitation was used initially until the pBr reached 2.3, and then controlled, double-jet precipitation was carried out at a pBr of 2.3 and 70° C. The tabular grains accounted for greater than 97% of total grain projected area. In this step the semi-batch reactor was used for double jet growth. The sizing properties of the final emulsion are shown in Table I.

EXAMPLE 2

AgBr grain nuclei were generated in a continuous stirred tank reactor (CSTR) at a pBr of 2.3 and 40° C., 2 g/L gelatin (lime-processed, deionized, bone gelatin), 0.033M suspension density, and an average residence time of 3 seconds. This was carried out by mixing at steady state in the CSTR reactor a gelatin solution (2.4 g/L, 500 mL/min.) with a NaBr solution (0.47M, 50 mL/min.) and a silver nitrate solution (0.40M, 50 mL/min). In this step the CSTR reactor was used to form the initial grain nuclei.

Twinning

These grain nuclei were transferred to a semi-batch reactor. The nucleation time, comprising grain nuclei formation and twinning, was 1 min. Initially, the semi-batch reactor was at a pBr of 1.3 and 40° C., 2 g/L gelatin (lime-processed, deionized, bone gelatin), 4.5 pH, and a total volume of 3 L. During the nuclei transfer, the semi-batch reactor was maintained at a pBr of 1.3 and 40° C. by controlled addition of a NaBr solution. In this step the semi-batch reactor was used to produce twinning. In the absence of this twinning step, the population fraction of tabular grains was drastically reduced.

Transition

After the nuclei from the CSTR reactor were added to the semi-batch reactor, the temperature was raised to 75° C. over a period of 4 minutes at the same pBr. The temperature increase was followed by a hold time of 8 minutes. Subsequently, a lime-processed, deionized, bone gelatin solution (at 4.5 pH) was dumped in the semi-batch reactor to bring the total volume in the semi-batch reactor to 13 L and a gelatin concentration of 4.4 g/L. Ultrafiltration was then used to wash the resulting emulsion to a final pBr of 2.3 and 70° C. over a period of 10 minutes. In this step the semi-batch reactor was used for ripening of the tabular grains formed by the twinning process.

Growth

The subsequent growth step was carried out with all reactants being added through the continuous CSTR reactor, while maintaining a constant volume in the semi-batch reactor using ultrafiltration. The reactants mixed through the CSTR reactor were a gelatin solution (4.5 pH, 4 g/L lime-processed, deionized, bone gelatin, 500 mL/min.), a mixed salt solution of NaBr and KI (0.67M, 3% iodide), and a silver nitrate solution (0.67M). The silver nitrate solution flow rate was ramped from 7.5 to 15 mL/min. in 30 min., from 15 to 40 mL/min. in 30 min., from 40 to 105 mL/min. in 50 min., and was then kept at the final flow rate until 3.8 moles of AgBrI (3% iodide) were precipitated. The pBr in the CSTR reactor during growth was maintained at 2.6 by controlling the mixed salt solution flow rate. The temperature in the CSTR reactor was controlled at 30° C. The pBr in the semi-batch reactor during growth was controlled at 2.3 by addition of a NaBr solution to this reactor, and the temperature of this reactor was 70° C. throughout growth. In this step the CSTR reactor was used for premixing the reactants, and the semi-batch reactor was used for growth. The tabular grains in the final emulsion accounted for greater than 97% of total grain projected area. The sizing statistics for this emulsion are shown in Table I.

TABLE I

| | ECD (μm) | ECD Stand. Dev. (μm) | ECD COV (%) | Proj. Area (%) | Thick-ness (μm) | Av. Aspect Ratio |
|---|---|---|---|---|---|---|
| Ex. 1E | 1.58 | 0.24 | 15 | 29 | 0.11 | 14 |
| Ex. 2E | 2.14 | 0.43 | 20 | 36 | 0.060 | 36 |

ECD = Equivalent Circular Diameter
Stand. Dev. = Standard Deviation
COV = Coefficient of Variation

EXAMPLE 3

AgBr grain nuclei were generated in a continuous stirred reactor at a pBr of 2.3, a temperature of 40° C., a particle suspension density of 0.033 moles AgBr per total volume, an average residence time of 1.5 s, and an average gelatin concentration of 2 g/L. The gelatin was a peroxide treated, lime processed, bone gelatin, hereinafter referred to as oxidized gelatin. The grain nuclei generation was carried out by mixing at steady state in the continuous reactor, a solution of oxidized (low methionine) gelatin (2.4 g/L, 1 L/min) with a NaBr solution (0.47M, 0.1 L/min) and a silver nitrate solution (0.4M, 0.1 L/min). In this step the continuous reactor was used to form the initial grain nuclei under well controlled conditions.

Preservation

The grain nuclei were transferred to a semi-batch reactor over a period of 1 min. Initially, the semi-batch reactor was at a pBr of 3.2, a temperature of 70° C., a concentration of oxidized gelatin of 2 g/L, a pH of 4.5, and a total volume 13 L, which was maintained using ultra-filtration. During the transfer time very little Ostwald ripening occurred in the semi-batch reactor.

Twinning

When the transfer of grain nuclei was completed, the pBr of the semi-batch reactor was changed to 1.4 by rapidly adding a NaBr solution. This step promoted twinning of the grain nuclei to form tabular grain nuclei.

Transition

The tabular grains were allowed to ripen at a pBr of 1.4 for 6 min. The temperature of the semi-batch reactor was maintained at 70° C. throughout the precipitation. At the end of the 6-min. hold time, the pBr was increased to 2.3 using ultra-filtration washing over a period of less than 14 min.

Growth

The subsequent growth step was carried out with all reactants being added through the continuous reactor and then transferred to the semi-batch reactor. The reactants mixed through the continuous reactor were a solution of oxidized gelatin (4.5 pH, 5 g/L, 0.5 L/min.), a silver nitrate solution (0.67M), and a mixed salt solution of NaBr and KI (0.67M, 3% iodide). The silver nitrate solution flow rate was ramped from 0.02 L/min. to 0.08 L/min. over a period of 30 min. The pBr of the continuous reactor during this growth step was maintained at a pBr of 2.6 by controlling the mixed salt solution flow rate. The temperature in the continuous reactor was controlled at 30° C. The pBr in the semi-batch reactor during growth was controlled at a pBr of 2.3 by addition of a NaBr solution to this reactor, and the temperature of this reactor was maintained at 70° C. In this step the continuous reactor was used for premixing the reactants, and the semi-batch reactor was used for growth. The tabular grains accounted for greater than 97% of the total grain projected area. The sizing statistics for this emulsion are shown in Table II.

EXAMPLE 4

AgBr grain nuclei were generated in a continuous stirred reactor at a pBr of 2.3, a temperature of 40° C., a particle suspension density of 0.033 moles AgBr per total volume, an average residence time of 1.5 s, and an average gelatin concentration of 2 g/L. The gelatin used was oxidized gelatin. The grain nuclei generation was carried out by mixing at steady state in the continuous reactor, a solution of oxidized (low methionine) gelatin (2.4 g/L, 1 L/min.) with a NaBr solution (0.47M, 0.1 L/min.), and a silver nitrate solution (0.4M, 0.1 L/min). In this step the continuous reactor was used to form the initial grain nuclei under well controlled conditions.

Preservation

The grain nuclei were transferred to a semi-batch reactor over a period of 2.0 min. Initially, the semi-batch reactor was at a pBr of 3.2, a temperature of 70° C., a concentration of oxidized gelatin of 2 g/L, a pH of 4.5, and a total volume of 13 L, which was maintained using ultrafiltration. During the transfer time very little Ostwald ripening occurred in the semi-batch reactor.

Twinning

When the transfer of grain nuclei was completed, the pBr of the semi-batch reactor was changed to 2.0 by rapidly adding an NaBr solution. This step promoted twinning of the grain nuclei to form tabular grain nuclei.

Transition

The tabular grains were allowed to ripen at a pBr of 2.0 for 6 min. The temperature of the semi-batch reactor was maintained at 70° C. throughout the precipitation. At the end of the 6-min. hold time, the pBr was increased to 2.3 using ultrafiltration washing over a period of less than 4 min.

Growth

The subsequent growth step was carried out with all reactants being added through the continuous reactor and then transferred to the semi-batch reactor. The reactants mixed through the continuous reactor were a solution of oxidized gelatin (4.5 pH, 5 g/L, 0.5 L/min.), a silver nitrate solution (0.67M), and a The silver nitrate solution flow rate was ramped from 0.02 L/min. to 0.08 L/min. over a period of 30 min., from 0.08 to 0.16 L/min. over 30 min., and remained constant at 0.16 L/min. for 24 min. The pBr of the continuous reactor during this growth step was maintained at a pBr of 2.6 by controlling the mixed salt solution flow rate. The temperature in the continuous reactor was controlled at 30° C. The pBr in the semi-batch reactor during growth was controlled at a pBr of 2.3 by addition of a NaBr solution to this reactor, and the temperature of this reactor was maintained at 70° C. In this step the continuous reactor was used for premixing the reactants, and the semi-batch reactor was used for growth. Tabular grains accounted for greater than 97% of total grain projected area. The sizing statistics for this emulsion are shown in Table II.

EXAMPLE 5

AgBr grain nuclei were generated in a continuous stirred reactor at a pBr of 2.3, a temperature of 40° C., a particle suspension density of 0.033 mole AgBr per total volume, an average residence time of 1.5 s, and an average gelatin concentration of 2 g/L. The gelatin used was oxidized gelatin. The grain nuclei generation was carried out by mixing at steady state in the continuous reactor, a solution of oxidized gelatin (2.4 g/L, 1 L/min.) with a NaBr solution (0.47M, 0.1 L/min.), and a silver nitrate solution (0.4M, 0.1 L/min). In this step the continuous reactor was used to form the initial grain nuclei under well controlled conditions.

Preservation

The grain nuclei were transferred to a semi-batch reactor over a period of 0.5 min. Initially, the semi-batch reactor was at a pBr of 3.2, a temperature of 70° C., a concentration of oxidized (low methionine) gelatin of 2 g/L, a pH of 4.5, and a total volume of 13 L, which was maintained using ultra-filtration. During the transfer time very little Ostwald ripening occurred in the semi-batch reactor.

Twinning

When the transfer of grain nuclei was completed, the pBr of the semi-batch reactor was changed to 2.0 by rapidly adding an NaBr solution. This step promoted twinning of the grain nuclei to form tabular grain nuclei.

Transition

The tabular grains were allowed to ripen at a pBr of 2.0 for 6 min. The temperature of the semibatch reactor was maintained at 70° C. throughout the precipitation. At the end of the 6-min. hold time, the pBr was increased to 2.3 using ultra-filtration washing over a period of less than 4 min.

Growth

The subsequent growth step was carried out with all reactants being added through the continuous reactor and then transferred to the semi-batch reactor. The reactants mixed through the continuous reactor were a solution of oxidized gelatin (4.5 pH, 5 g/L, 0.5 L/min.), a silver nitrate solution (0.67M), and a mixed salt solution of NaBr and KI (0.67M, 3% iodide). The silver nitrate solution flow rate was ramped from 0.02 L/min. to 0.08 L/min. over a period of 30 min., from 0.08 to 0.16 L/min. over 30 min., and remained constant at 0.16 L/min. for 24 min. The pBr of the continuous reactor during this growth step was maintained at a pBr of 2.6 by controlling the mixed salt solution flow rate. The temperature in the continuous reactor was controlled at 30° C. The pBr in the semi-batch reactor during growth was controlled at a pBr of 2.3 by addition of a NaBr solution to this reactor, and the temperature of this reactor was maintained at 70° C. In this step the continuous reactor was used for premixing the reactants, and the semi-batch reactor was used for growth. The tabular grains accounted for greater than 99 percent of total grain projected area. The sizing statistics for this emulsion are shown in Table II.

TABLE II

| | ECD (μm) | COV of ECD (%) | Thickness (μm) | Aspect Ratio |
|---|---|---|---|---|
| Example 3 | 0.9 | 25 | 0.034 | 26 |
| Example 4 | 1.5 | 23 | 0.036 | 42 |
| Example 5 | 2.2 | 20 | 0.038 | 58 |

ECD = Equivalent Circular Diameter
COV = Coefficient of Variation (standard deviation of ECD/ECD)

EXAMPLES 6-10 INCLUSIVE

These Examples have as their purpose to demonstrate the superior features of photographic elements of the invention.

EMULSIONS SELECTED FOR COMPARISON

The prefix TE indicates emulsions that satisfy the EM2 requirements of the invention. The prefix TC indicates control emulsions failing to satisfy one or more EM2 requirements.

TC-1

This control emulsion is a remake of the emulsion of Example 3 of Kofron et al U.S. Pat. No. 4,439,520. The emulsion was selected as representing a a closely related conventional silver bromoiodide tabular grain emulsion in which the tabular grains account for a high percentage of total grain projected area. The properties of the emulsion are summarized in Table III. The 0.12 μm mean thickness of the tabular grains clearly distinguishes the emulsion from an emulsion required to satisfy EM2 emulsion layer requirements in the photographic elements of the invention. Tabular grains accounted for 97% of total grain projected area, which was just below tabular grain projected area requirements for emulsions satisfying the requirements of the invention.

TC-2

This control is a remake of the emulsion of Example 16 of Daubendiek et al U.S. Pat. No. 4,914,014. The emulsion was selected as representing a conventional silver bromoiodide ultrathin tabular grain emulsion.

The properties of the emulsion are summarized in Table III. The fact that the tabular grains accounted for only 86 percent of total grain projected area clearly distinguishes the emulsion from an emulsion required to satisfy EM2 emulsion layer requirements in the photographic elements of the invention.

TE-3, TE-4

These emulsions, both satisfying the EM2 emulsion layer requirements of the photographic elements of the invention, were prepared by the same general type of preparation procedure. Emulsion TE-3 contained overall iodide content of 3 mole percent, based on total silver, while TE-4 had an overall iodide content of 3.34 mole percent.

TE-4 was made as follows. A reaction vessel equipped with a stirrer was charged with 3.0 liters of water solution that contained 7.5 g oxidized (low methionine), lime-processed bone gelatin, 20 mMoles NaBr, an antifoamant, and sufficient sulfuric acid to adjust the pH to 1.88. Nucleation was carried out at 35° C. by making a balanced, double-jet addition of 16 mL each 1.25M silver nitrate and a 1.25M halide solution that was 94 mole-% NaBr and 6 mole-% KI at a flow rate of 80 mL/min. Following these additions for nucleation, the temperature was raised to 60° C. over a period of 15 minutes. After this temperature adjustment, 100 g oxidized lime-processed bone gelatin in a 500 mL water solution was added to the reactor, the pH was adjusted to 6 with NaOH, and the pBr was adjusted to 1.77 by addition of 40 mL 1M NaBr. Eighteen minutes after nucleation, growth was begun at the corresponding pAg, by addition of 1.2M silver nitate, NaBr, and a suspension of AgI. Silver nitrate flow was initially at 33 mL/min, and it was accelerated at a rate of 0.133 mL/min$^2$ for a period of 30 minutes, then it was accelerated at a rate of 1.9 mL/min$^2$ until delivery of reactant silver nitrate was complete. During this time, the flow of AgI was coupled to that of silver nitrate so that the Ag(Br,I) composition was uniformly 3.33% I, and the flow of sodium bromide was regulated so that the pAg was maintained at the value cited for the start of growth. A total of 3.92 moles of silver halide was precipitated, and the resulting emulsion was washed by the coagulation method.

TE-5, TE-8, TE-9, TE-10, TE-11

These silver bromoiodide emulsions were prepared by the process of this invention similarly as the emulsions of Examples 3 and 4, respectively, described above, but with preparation conditions adjusted to increase tabular grain projected areas to greater than 99% of total grain projected area, with some (3 and 9%, respectively) attendant increase in emulsion coefficients of variation. Overall iodide content was 3 mole percent, based on silver.

TE-6

TE-6 was prepared by thickening the tabular grains of an emulsion prepared by a procedure generally similar to that employed for TE-5. The overall iodide content was 3 mole percent, based on silver.

TC-7

This silver bromoiodide control, was not taken from any specific teaching in the art, but was prepared to demonstrate the inferior properties of an emulsion having a tabular grain projected area accounting for 99.4% of total grain projected area and failing to satisfy the requirements of the invention solely by reason of having a thickness greater than 0.07 μm, specifically 0.12 μm—i.e., a thickness similar to that of TC-1. The overall iodide content of this control was 3 mole percent, based on silver.

TC-12

This silver bromoiodide control was a remake of Emulsion TC-17 in Daubendiek et al U.S. Pat. No. 4,693,964. This control was selected to demonstrate the highest average ECD emulsion of Daubendiek et al. The control fails to satisfy EM2 requirements solely in having an average ECD of less than 0.7 μm, specifically 0.6 μm. The control contained an overall iodide content of 3.02 mole percent, based on total silver.

The characteristics of the emulsions are summarized below in Table III.

TABLE III

| Emul. | ECD μm | t μm | ECD t | TGPA % |
|---|---|---|---|---|
| TC-1 | 1.5 | 0.12 | 12:1 | 97.0 |
| TC-2 | 0.73 | 0.036 | 20:1 | 86.0 |
| TE-3 | 1.5 | 0.048 | 31:1 | 99.8 |
| TE-4 | 0.7 | 0.046 | 15:1 | 98.5 |
| TE-5 | 0.88 | 0.034 | 26:1 | 99.3 |
| TE-6 | 0.94 | 0.065 | 14:1 | 99.7 |
| TC-7 | 1.07 | 0.124 | 9:1 | 99.4 |
| TE-8 | 1.51 | 0.034 | 44:1 | 99.6 |
| TE-9 | 1.62 | 0.035 | 46:1 | 99.7 |
| TE-10 | 2.14 | 0.035 | 61:1 | 99.7 |
| TE-11 | 2.27 | 0.037 | 61:1 | 99.7 |
| TC-12 | 0.6 | 0.045 | 13:1 | 99.3 |

EXAMPLE 6

Comparisons of Specularity of Varied Optical Causer Layers

In this example the light scattering of coatings of all of the emulsions reported in Table III were measured. All of the emulsions are high aspect tabular grain emulsions. Grain ECD's were measured on scanning electron micrographs (SEM's). The tabular grain thicknesses for the emulsions (except TC-1 which was measured by SEM) reported in Table III were determined using a dye adsorption technique. The level of the cyanine dye, 1,1'-diethyl-2,2'-cyanine bromide required for complete saturation of the crystal surfaces was determined. It was assumed that each dye molecule occupied 0.566 nm$^2$ and on this basis the total surface area of the emulsion was determined. Using this area determination and the ECD (determined from SEM's) the expression for surface area was solved for thickness. The high percentage of total grain projected area accounted for by tabular grains allowed accurate measurements with this sizing approach.

The TC and TE emulsions were coated in a range from 0.430 g/m$^2$ silver to 2.15 g/m$^2$ silver on cellulose acetate support. The coatings were prepared at either 1.61 g/m$^2$ gelatin or, for the highest silver levels, 2.69 g/m$^2$ gelatin. A protective topcoat of 1.08 g/m$^2$ gelatin was applied that also contained a hardening agent coated at a level of 1.75% with respect to the total gelatin levels used.

The transmittance of these coatings and specularity of the transmitted light were determined using a Diano-Match-Scan II TM spectrophotometer equipped with a 178 mm integrating sphere. The transmittance is measured over the wavelength range from 400 nm to 700 nm as taught by Kofron et al U.S. Pat. No. 4,439,520. The specularity of the transmitted light was determined using the same equipment but restricting the detector's aperture so as to sample only the amount of light passing through a 7° cone angle. Normalized specularity is then the ratio of the transmitted specular light to the total transmitted light. The percent transmittance and the percent normalized specular transmittance at either 550 nm or 650 nm were plotted versus silver laydown. The silver laydown corresponding to 70 percent total transmittance was determined from these plots and used to obtain the percent normalized specular transmittance at both 550 nm and 650 nm. These values are reported in Table IV. The larger the transmittance percentage, the higher the specularity of the transmitted light, the greater the anticipated advantage in terms of sharpness of the underlying (e.g., EM1) emulsion layers.

TABLE IV

Percent Normalized Specular Transmittance at 550 nm and 650 nm for Silver Laydowns Corresponding to 70% Total Transmittance

| Emulsion No. | 550 nm | 650 nm |
|---|---|---|
| TC-1 | 8.5% | 13.5% |
| TC-2 | 23.5% | 20.0% |
| TE-3 | 56.0% | 54.5% |
| TE-4 | 55.5% | 55.0% |
| TE-5 | 60.5% | 58.0% |
| TE-6 | 52.0% | 53.5% |
| TC-7 | 5.5% | 14.5% |
| TE-8 | 64.0% | 57.0% |
| TE-9 | 66.0% | 58.5% |
| TE-10 | 70.5% | 62.5% |
| TE-11 | 65.0% | 56.5% |
| TC-12 | 47.0% | 49.0% |

All of the TC emulsions exhibited transmittance percentages below the lowest transmittance percentage of the TE emulsions. Controls TC-1, TC-2 and TC-7 provided exceptionally low levels of transmittance.

EXAMPLE 7

Comparison of Resolving Power of an Optical Receiver Layer when Emulsions TC-1, TC-2, TE-3, and TE-4 are Used as Optical Causer Layers.

The optical impact of high aspect ratio tabular grain emulsions on sharpness is often measured by placing a layer containing these emulsions (the optical causer layer) over at least one underlying layer that is sensitive in the spectral region of interest (the optical receiver layer). Imagewise exposures of the underlying layers are made by light transmitted by the causer layer. Degradation of the actinic exposure by the optical causer layer can be measured by the sharpness recorded by the optical receiver layer.

The format that was used to audit the optical impact of the optical causer layer has the general structure described in Table V. A cellulose acetate film support with a back side Rem jet TM antihalation layer was coated with the indicated layers, in sequence, with Layer 1 being coated nearest the support.

TABLE V

Multilayer for Evaluating Optical Impact of TC-1, TC-2, TE-3, and TE-4

| | |
|---|---|
| Layer 1: | Slow Cyan |
| | 0.288 g/m$^2$ of a red sensitized cubic grain silver bromoiodide (3.5% iodide) emulsion with an edge length of 0.042 μm and chemically sensitized with sulfur and gold sensitizers. |

TABLE V-continued

Multilayer for Evaluating Optical Impact of TC-1, TC-2, TE-3, and TE-4

| | |
|---|---|
| | 0.347 g/m$^2$ of cyan image-dye forming coupler C-1. |
| | 0.072 g/m$^2$ of masking coupler MC-1. |
| | 0.031 g/m$^2$ of cyan absorber dyes. |
| | 3.068 g/m$^2$ of gelatin vehicle. |
| Layer 2: | Mid cyan |
| | 0.187 g/m$^2$ of a red sensitized cubic grain silver bromoiodide (3.5% iodide) emulsion with an edge length of 0.072 μm and chemically sensitized with sulfur and gold sensitizers. |
| | 0.161 g/m$^2$ of cyan image-dye forming coupler C-1. |
| | 0.052 g/m$^2$ of masking coupler MC-1. |
| | 0.023 g/m$^2$ of cyan absorber dyes. |
| | 0.727 g/m$^2$ of gelatin vehicle. |
| Layer 3: | Fast cyan |
| | 0.230 g/m$^2$ of 50% by weight red sensitized cubic grain silver bromoiodide (3.5% iodide) emulsion with an edge length of 0.136 μm and chemically sensitized with sulfur and gold sensitizers with 50% by weight red sensitized cubic grain silver bromoiodide (3.5% iodide) emulsion with an edge length of 0.091 μm and chemically sensitized with sulfur and gold sensitizers |
| | 0.114 g/m$^2$ of cyan image-dye forming coupler C-1. |
| | 0.005 g/m$^2$ of masking coupler MC-1. |
| | 0.027 g/m$^2$ of cyan absorber dyes. |
| | 0.807 g/m$^2$ of gelatin vehicle. |
| Layer 4: | Interlayer |
| | 0.700 g/m$^2$ of gelatin vehicle. |
| | 0.269 g/m$^2$ DOX-1. |
| Layer 5: | Slow Magenta |
| | 0.389 g/m$^2$ of green sensitized cubic grain silver bromoiodide (3.5% iodide) emulsion with an edge length of 0.056 μm and chemically sensitized with sulfur and gold sensitizers. |
| | 0.329 g/m$^2$ of magenta image-dye forming coupler M-1. |
| | 0.104 g/m$^2$ of masking coupler MC-2. |
| | 0.015 g/m$^2$ of magenta absorber dye. |
| | 2.530 g/m$^2$ of gelatin vehicle. |
| Layer 6: | Mid Magenta |
| | 0.217 g/m$^2$ of green sensitized cubic grain silver bromoiodide (3.5% iodide) emulsion with an edge length of 0.080 μm and chemically sensitized with sulfur and gold sensitizers. |
| | 0.140 g/m$^2$ of magenta image-dye forming coupler M-1. |
| | 0.073 g/m$^2$ of masking coupler MC-2. |
| | 0.014 g/m$^2$ of magenta absorber dye. |
| | 0.727 g/m$^2$ of gelatin vehicle. |
| Layer 7: | Fast Magenta |
| | 0.271 g/m$^2$ of green sensitized cubic grain silver bromoiodide (3.5% iodide) emulsion with an edge length of 0.115 μm and chemically sensitized with sulfur and gold sensitizers. |
| | 0.029 g/m$^2$ of magenta image-dye forming coupler M-1. |
| | 1.051 g/m$^2$ of magenta image-dye forming coupler M-2. |
| | 0.014 g/m$^2$ of masking coupler MC-2. |
| | 0.024 g/m$^2$ of magenta absorber dye. |
| | 0.727 g/m$^2$ of gelatin vehicle. |
| Layer 8: | Interlayer |
| | 0.700 g/m$^2$ gelatin vehicle. |
| | 0.269 g/m$^2$ of DOX-1 |
| | 0.065 g/m$^2$ of yellow filter dye Y-1. |
| Layer 9: | Interlayer |
| | 2.422 g/m$^2$ of gelatin vehicle. |
| | 1.841 g/m$^2$ of blank oil phase |

TABLE V-continued

| Multilayer for Evaluating Optical Impact of TC-1, TC-2, TE-3, and TE-4 | |
|---|---|
| | dispersion. |
| Layer 10: | Optical causer layer<br>2.153 g/m$^2$ of gelatin vehicle.<br>0.872 g/m$^2$ of blank oil phase dispersion.<br>Tabular grain emulsions selected as shown in Table VI of this example. |

TABLE V-continued

| Multilayer for Evaluating Optical Impact of TC-1, TC-2, TE-3, and TE-4 | |
|---|---|
| Layer 11: | Protective Overcoat<br>1.076 g/m$^2$ of gelatin vehicle.<br>Hardener at 1.75% of total gelatin. |

Y-1, MC-1-C-1, DOX-1, M-1, MC-2, M2, and MC-3 are identified as follows:

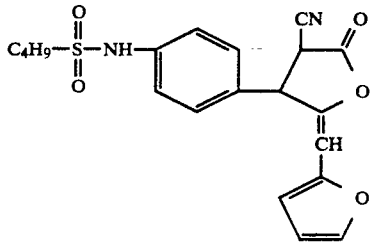

Y-1

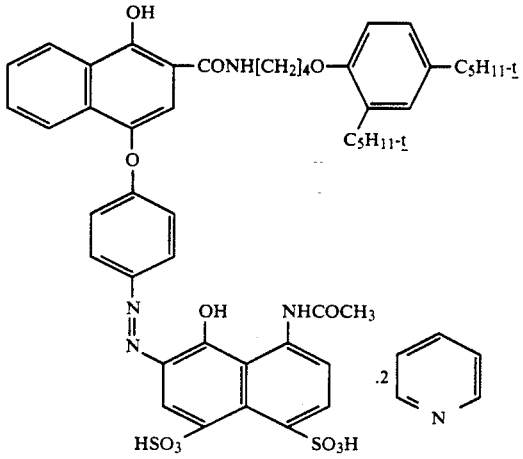

MC-1

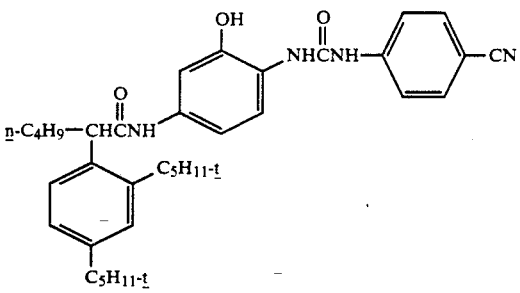

C-1 didodecylhydroquinone

DOX-1

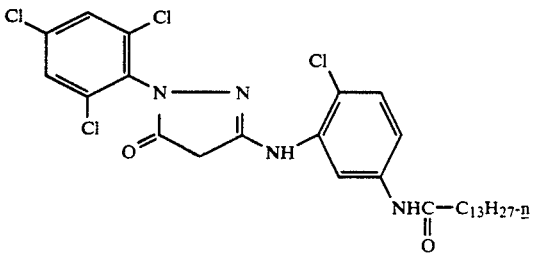

M-1

-continued

MC-2

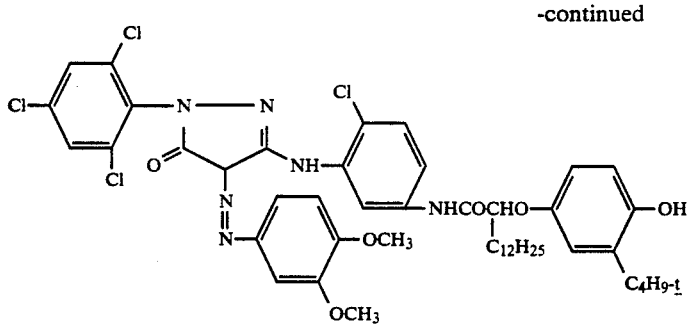

M-2

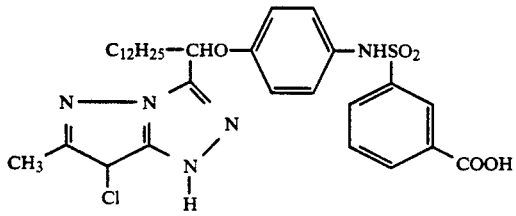

MC-3

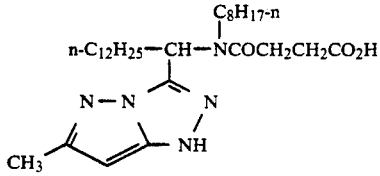

The impact of the optical causer layer on the optical receiver layer can be measured based on the resolving power (cycles/mm) of the optical receiver layer. The latter is obtained using a sinusoidal exposure input modulation. Reported in Table VI is the resolving power of the optical receiver layer after the multilayer was exposed in the cited spectral region and processed through the conventional Eastman TM color negative process. This resolving power was determined at a point where the input modulation was degraded by 50 percent. The reference position is that obtained when no silver is present in the optical causer layer. The silver levels are those used to obtain 70 percent transmission at either 550 nm or 650 nm.

TABLE VI

| Resolving Power of Optical Receiver Layer | |
|---|---|
| Emulsion No. | cycles per mm |
| A) Resolving Power of Optical Receiver's Green Record when Optical Causer Layer Transmits 70% of the Light at 550 nm. | |
| Gel only Ref | 94 |
| TC-1 | 43 |
| TC-2 | 41 |
| TE-3 | 86 |
| TE-4 | 75 |
| B) Resolving Power of Optical Receiver's Red Record when Optical Causer Layer Transmits 70% of the Light at 650 nm. | |
| Gel only Ref | 87 |
| TC-1 | 36 |
| TC-2 | 31 |
| TE-3 | 72 |
| TE-4 | 58 |

Emulsion TC-1 (Kofron et al) has the same equivalent circular diameter as does the emulsion of the invention TE-3. Both emulsions have high percentages of total grain projected areas accounted for by tabular grains, Table III, yet it is clear from the data in Table IV that the specularity of the transmitted light from TC-1 (8.5% at 550 nm or 13.5% at 650 nm when 70% of the incident light is transmitted through the emulsion) is inferior to that obtained with emulsion TE-3 (56.0% at 550 nm or 54.5% at 650 nm when 70% of the incident light is transmitted through the emulsion).

When these emulsions are coated as optical causer layers at silver laydowns that correspond to matched transmission of light at either 550 nm or 650 nm it is clear that the resolving power of the optical detector layer is nearly doubled when TE-3 is present in the optical causer layer compared to the results obtained when TC-1 is present in the optical causer layer. Thus the impact of significantly improving the specularity of the transmitted light as occurs with our invention directly translates to significant improvements to the sharpness of underlying records.

Emulsion TC-2 (U.S. Pat. No. 4,914,014) was comparable to Emulsion TE-4 in terms of tabular grain dimensions. It is clear from the data reported in Table IV that TE-4 has significantly greater specularity at either 550 nm or 650 nm than does TC-2 when each transmits 70 percent of the incident light. The data in Table VI illustrate that this also translates into significantly improved resolving power for the optical detector layer when TE-4 is present in the optical causer layer versus the comparative emulsion, TC-2.

EXAMPLE 8

Effect of Thickness of High Aspect Ratio Tabular Grain Emulsion on Specularity of Transmitted Light Example 7 compares the performance of two emulsions with the same equivalent circular diameter. The data clearly demonstrate that the optical performance of the high aspect ratio tabular grain emulsion of this invention, TE-3, is superior to the optical performance of the comparative example, TC-1. Both emulsions have a high percentage of total grain projected area accounted for by tabular grains. TC-1 and TE-3 have the same ECD, but vary with respect to emulsion thickness.

The impact of thickness on the normalized specular transmission of the emulsions was also examined by thickening a host emulsion prepared according to the invention, TE-5. Emulsions TE-6 and TE-7 were prepared similarly as TE-5, except that additional growth was conducted that increased the average ECD of the emulsions slightly, but primarily increased their thickness. Each of emulsions TE-5, TE-6 and TE-7 had more than 99 percent of their total grain projected area accounted for by tabular grains.

The data in Table IV demonstrate that at a constant transmittance of 70% of the incident light, the percent normalized specularity decreases as the thickness increases. The change in specularity is at first small as the thickness is increased from 0.034 microns to 0.065 μm, but becomes precipitous as the thickness is again nearly doubled to 0.124 μm. It is therefore clear that using the high aspect ratio, highly specular thin tabular grain emulsions of this invention in multilayer structures will lead to photographic elements capable of extremely high resolving power.

EXAMPLE 9

Impact of ECD Variations on the Specularity of Transmitted Light

The impact of the mean equivalent circular diameter of the tabular grains on the specularity of the transmitted light requires that the tabular emulsions have similar thicknesses as indicated in reference to Example 7. The teachings of this invention were used to prepare a series of emulsions with mean ECD's that ranged from 0.7 μm to 2.27 μm. These emulsions include TE-4 (0.7 μm mean ECD), TE-5 (0.88 μm mean ECD), TE-8 (1.51 μm mean ECD), TE-9 (1.62 μm mean ECD), TE-10 (2.14 μm mean ECD), and TE-11 (2.27 μm mean ECD). Other physical characteristics of these emulsions are given in Table III. The data of Table IV clearly show that at 70 percent transmittance of the incident light at either 550 nm or 650 nm the percent normalized specularity remains nearly constant for these high aspect ratio ultrathin tabular grain emulsions of this invention. It is known in the art that the photographic speed of an emulsion in the spectral region increases as the mean ECD of the emulsion grains increases. Therefore it is clear that multilayers of extremely high sharpness can be prepared using the teachings of this invention and that these photographic elements can cover the camera speed range from medium and high speed.

EXAMPLE 10

Relative Speed of the Emulsions for Medium to High Speed Applications

The application of this invention to camera speed film that span the range of medium to high speed requires that the spectral speed of these emulsions be sufficient to accommodate the system speed aims. Daubendiek et al U.S. Pat. No. 4,693,964 discloses multicolor photographic elements of moderate camera speed. Daubendiek et al emulsion TC-16, the largest mean ECD tabular grain emulsion reported, was been selected as a control as being the emulsion most closely approximating the requirements of the invention. Daubendiek et al emulsion TC-16 was remade to approximately the same dimensions as TC-12, as reported in Table III. This emulsion had a higher specularity percentage than the other control emulsions (see Table IV), but specularity percentage was lower than that of all of the emulsions satisfying the EM2 requirements of the invention. TE-4, the example emulsion in Table IV having the lowest percentage specular transmission, was chosen for further comparison with TC-12 to demonstrate the advantages of the invention over the teachings of Daubendiek et al U.S. Pat. No. 4,693,964.

Both emulsions were optimally finished using sulfur (as sodium thiosulfate) and gold (as potassium tetrachloroaurate). Two green spectral sensitizers, SD-2, anhydro-5-chloro-9-ethyl-5'-phenyl-3'-(3-sulfobutyl)-3-(3-sulfopropyl)oxacarbocyanine hydroxide sodium salt, and SD-3, anhydro-9-ethyl-3,3'-bis(3-sulfopropyl)-4,5,4',5'-dibenzooxacarbocyanine hydroxide, sodium salt, were used at the same ratio but at levels that were optimum for each emulsion. The emulsions were individually coated on acetate support at 0.269 g/m$^2$ of silver with a magenta image dye-forming coupler MC-3 (0.398 g/m$^2$) using a gelatin vehicle (3.229 g/m$^2$) and a topcoat of gelatin (4.306 g/m$^2$) and hardener at 1.75% of the total coated gelatin. These photographic elements were given a standard minus blue stepped exposure and processed using a conventional C41 TM process as described in, for example, the *British Journal of Photography Annual* of 1988, pages 196–198. Three times of development were used: 2.5 minutes, 3.25 minutes, and 4 minutes. The relative speeds of the emulsions were determined for each condition at fixed density of 0.15 density units above Dmin. The relative speeds of these two emulsions are given below for a matched Dmin of 0.05 density units.

| Emulsion | Relative Speed |
|---|---|
| TC-12 | 100 |
| TE-4 | 135 |
| Sensitivity = 100/EH | |

EH represents an exposure required to obtain 0.15 density above Dmin. It is clear from the data that the emulsion of this invention is significantly faster than the comparative example and more suitable for medium camera speed applications.

The invention has been described in detail with particular reference to preferred embodiments thereof, but it will be understood that variations and modifications can be effected within the spirit and scope of the invention.

What is claimed is:

1. A photographic element comprised of a support, a first silver halide emulsion layer coated on the support and sensitized to produce a photographic record when exposed to specular light within the minus blue visible wavelength region of from 500 to 700 nm, a second silver halide emulsion layer capable of producing a second photographic record coated over the first silver halide emulsion layer to receive specular minus blue light intended for the exposure of the first silver halide emulsion layer, the second silver halide emulsion layer being capable of acting as a transmission medium for delivery of at least a portion of the minus blue light intended for the exposure of the first silver halide emulsion layer in the form of specular light, the second silver halide emulsion layer being comprised of a dispersing medium and silver halide grains including tabular grains having {111} major faces, characterized in that greater than 97 percent of the total projected area of the silver halide grains having an equivalent circular diameter of at least 0.2 μm of the second emulsion layer is accounted for by silver bromoiodide tabular grains having an average equivalent circular diameter of at least 0.7 μm and an average thickness of less than 0.07 μm.

2. A photographic element according to claim 1 further characterized in that greater than 97 percent of the total projected area of the silver halide grains having an equivalent circular diameter of at least 0.1 μm of the second emulsion layer is accounted for by silver bromoiodide tabular grains having an average equivalent circular diameter of at least 0.7 μm and an average thickness of less than 0.07 μm.

3. A photographic element according to claim 31 further characterized in that greater than 97 percent of the total projected area of the silver halide grains having an equivalent circular diameter of at least 0.05 μm of the second emulsion layer is accounted for by silver bromoiodide tabular grains having an average equivalent circular diameter of at least 0.7 μm and an average thickness of less than 0.07 μm.

4. A photographic element according to claim 1 further characterized in that the silver bromoiodide tabular grains account for greater than 99 percent of said total projected area.

5. A photographic element according to claim 1 further characterized in that the grains having an equivalent circular diameter of greater than 0.2 μm exhibit a coefficient of variation of less than 25 percent.

6. A photographic element according to claim 1 further characterized in that the grains having an equivalent circular diameter of greater than 0.2 μm exhibit a coefficient of variation of less than 20 percent.

7. A photographic element according to claim 1 further characterized in that the silver bromoiodide tabular grains have an average thickness of less than 0.05 μm.

8. A photographic element according to claim 1 further characterized in that greater than 90 percent of the tabular grains are hexagonal.

9. A photographic element according to claim 1 further characterized in that the first silver halide emulsion layer is panchromatically sensitized.

10. A photographic element according to claim 1 further characterized in that the first silver halide emulsion layer is orthochromatically sensitized.

11. A photographic element according to claim 1 further characterized in that the first silver halide emulsion layer is sensitized to red light.

12. A photographic element according to claim 1 further characterized in that the first silver halide emulsion layer is sensitized to green light.

13. A photographic element according to claim 1 further characterized in that the photographic element is a multicolor photographic element containing red, green and blue recording dye image forming layer units and the first silver halide emulsion layer is located in one of the red and green recording dye image forming layer units.

* * * * *